United States Patent [19]

Kurosu et al.

[11] Patent Number: 4,973,835

[45] Date of Patent: Nov. 27, 1990

[54] ACTIVELY-ILLUMINATED ACCESSORY

[76] Inventors: Etsurou Kurosu, 16-7, Nishimine-machi, Ohta-ku, Tokyo 145; Minoru Maeda, 36-7, Matsubara 1-chome, Setagaya-ku, Tokyo 156, both of Japan

[21] Appl. No.: 443,203

[22] Filed: Nov. 30, 1989

[51] Int. Cl.[5] ..... H01J 40/14

[52] U.S. Cl. ..... 250/214 AL; 315/158

[58] Field of Search ..... 250/215, 214 AL; 340/757, 762, 766, 815.03, 815.06, 815.07, 815.1; 362/104; 315/153, 155, 158

[56] References Cited

U.S. PATENT DOCUMENTS 4,605,882 8/1986 DeLuca ..... 315/158

4,777,408 10/1988 DeLuca ..... 362/104

*Primary Examiner*—David C. Nelms

*Attorney, Agent, or Firm*—Cushman, Darby & Cushman

[57] ABSTRACT

This invention discloses an accessory utilizing a light emitter, including the light emitter, arranged near a transparent body, for intermittently emitting light upon reception of an electrical signal, first pulse generator for generating a first pulse signal at a relatively short pulse interval, photo detector for detecting light incident on the transparent body and generating a light detection signal, second pulse generator for generating a second pulse signal at a relatively long pulse interval, and signal processor for receiving the first pulse signal, the second pulse signal, and the light detection signal and supplying the electrical signal to the light emitter at a predetermined timing.

20 Claims, 10 Drawing Sheets

CLOCK
0 1 2 3 4 5 6 7 8 9 10 11 12 13 14 15 0
CARRY OUT
CLEAR
Q0
Q1
Q2
Q3
T1
T2

| CLOCK | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| Q0 (RED) | | ON | | ON | | ON | | ON | | ON | | ON | | ON | | ON |
| Q1 (BLU) | | | ON | ON | | | ON | ON | | | ON | ON | | | ON | ON |
| Q2 (GRN) | | | | | ON | ON | ON | ON | | | | | ON | ON | ON | ON |
| Q3 (YEL) | | | | | | | | | ON | ON | ON | ON | ON | ON | ON | ON |

Fig. 8

ACTIVELY-ILLUMINATED ACCESSORY

BACKGROUND OF THE INVENTION

1. Field of the Invention

The present invention relates to an accessory utilizing a light emitter.

2. Description of the Related Art

As accessories, rings, earrings, pendants, and the like utilizing gems, imitation doublets, and the like (to be referred to as "accessory bodies" hereinafter) are known. These accessories exhibit colors and brilliance unique to their accessory bodies when light is transmitted, refracted, or reflected in the accessory bodies, thereby giving aesthetic stimulations to those who see them.

However, these accessories cannot provide colors and brilliance unique to their accessory bodies unless light is incident onto their accessory bodies from the outside.

The color of a conventional accessory is uniformly determined according to a gem to be used and its arrangement, and the number of kinds of colors depends on combinations of gems used. For this reason, there is no originality in visual stimulation, and the degree of freedom of design is low.

Furthermore, when a gem is used as an accessory body, it is difficult to work, resulting in an expensive accessory.

SUMMARY OF THE INVENTION

It is a first object of the present invention to provide an accessory which can provide a color and brilliance unique to its accessory body even if no light is incident onto the accessory body from the outside.

It is a second object of the present invention to provide an accessory which has an originality in aesthetic stimulation and a high degree of freedom in design.

It is a third object of the present invention to provide an accessory which can be easily worked and is relatively inexpensive.

In order to achieve these objects, according to the present invention, there is provided an accessory utilizing a light emitter, comprising: the light emitter, arranged near a transparent body, for intermittently emitting light upon reception of an electrical signal; first pulse generator for generating a first pulse signal at a relatively short pulse interval; photo detector for detecting light incident on the transparent body and generating a light detection signal; second pulse generator for generating a second pulse signal at a relatively long pulse interval; and signal processor for receiving the first pulse signal, the second pulse signal, and the light detection signal and supplying the electrical signal to the light emitter at a predetermined timing.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 8 shows an output signal table of electrical signals output to the signal processor according to the first embodiment of the present invention;

DESCRIPTION OF THE PREFERRED EMBODIMENTS

Figure 1:
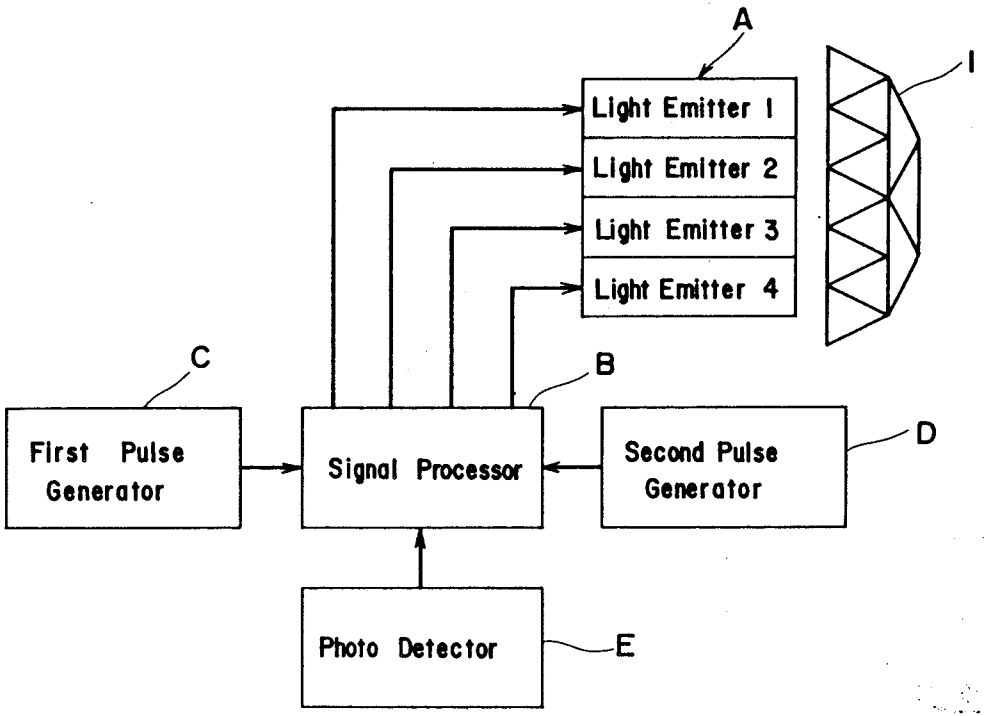
FIG. 1 is a block diagram showing a basic arrangement of an accessory according to the first embodiment of the present invention.

FIG. 1 shows the basic structure of the accessory according to the first embodiment of the present invention. The present invention basically comprises a light emitter A, a signal processor B, a first pulse generator C, a second pulse generator D, and a photo detector E.

The light emitter A is arranged in or near a transparent body 1, and is connected to the signal processor B. The signal processor B is connected to the first pulse generator C, the second pulse generator D, and the photo detector E.

One or a plurality of light-emitting members A may be arranged, and a light-emitting element such as an LED may be used. The light emitter A externally emits light through the transparent body 1. The first pulse generator C generates a first pulse signal having a relatively short pulse interval, and the second pulse generator D generates a second pulse signal having a pulse interval at least longer than the first pulse signal. The photo detector E detects light incident from the transparent body 1, and generates a light detection signal. These signals are supplied to the signal processor B and are subjected to predetermined signal processing.

More specifically, only when the signal processor B receives the second pulse signal and does not receive the light detection signal, it controls a light-emission timing to cause the light emitter A to emit light based on the first pulse signal. For this reason, when incidence of light to the transparent body 1 is stopped, the light emitter A is repeatedly turned on/off to intermittently emit light. In this case, an ON/OFF time depends on the pulse interval of the second pulse signal.

Figure 2:
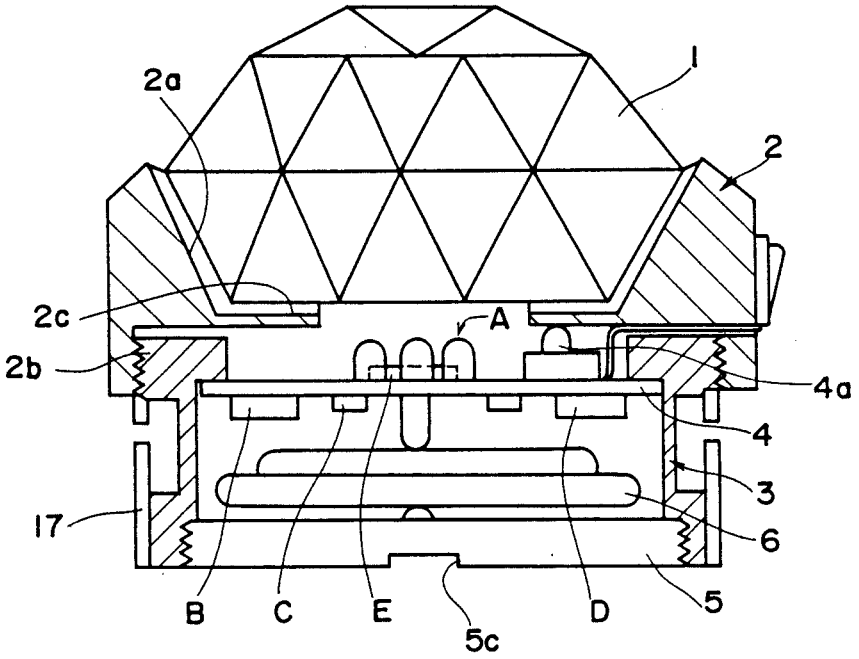
FIG. 2 is a longitudinal sectional view showing a structure of the accessory according to the first embodiment of the present invention.
Figure 3:
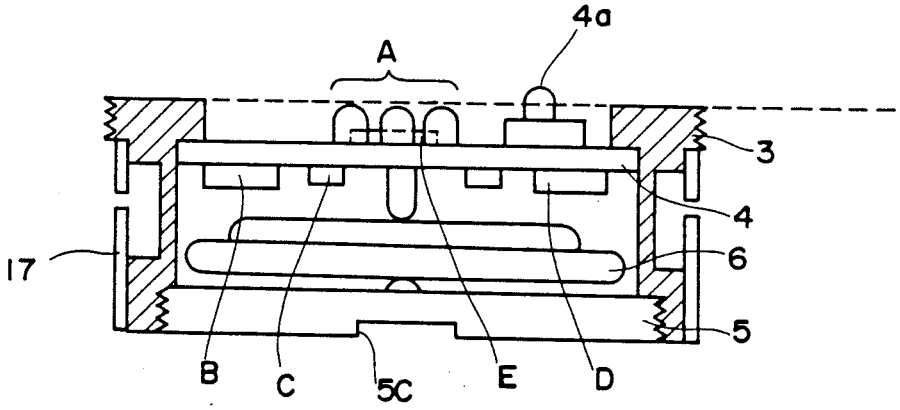
FIG. 3 is a partial, longitudinal sectional view of the structure, excluding a transparent body, of the accessory according to the first embodiment of the present invention.
Figure 4:
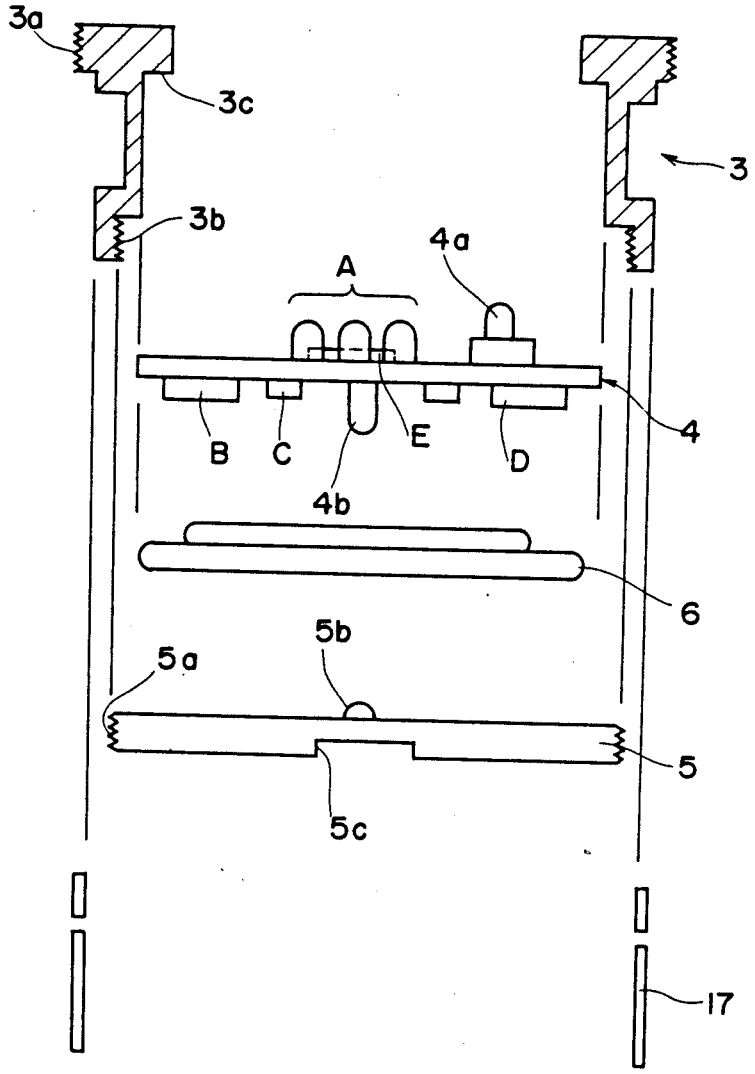
FIG. 4 is a partial exploded view of the structure of the accessory shown in FIG. 3.

The structure of the accessory according to the embodiment of the present invention will be described below with reference to FIGS. 2 to 4. The accessory basically comprises the transparent body 1, a transparent body fixing member 2, a board fixing member 3, a circuit board 4, and a battery holding member 5.

The surface of the transparent body 1 is cut into, e.g., a polyhedron, so that internal light is satisfactorily reflected, refracted, or diffused by the whole surface. The transparent body 1 may or may not be colored. The transparent body 1 is fixed to the transparent body fixing member 2 of, e.g., plastic, which does not allow light to pass therethrough.

A holding portion 2*a* for holding the transparent body 1 is formed on the upper portion of the transparent body fixing member 2, and the transparent body 1 is held thereon through an adhesive or claw (not shown). A coupling portion 2*b* having female threads on its inner surface is formed on the lower portion of the transparent body fixing member 2 to mount the board fixing member 3. Furthermore, a fringe 2*c* is formed at the central portion of the transparent body fixing member 2. A switch 4*a* fixed on the circuit board 4 is pressed by the fringe 2*c*. A switch 2*d* is fixed on the surface of the transparent body fixing member 2 and is connected to the circuit board 4 by lead wire.

The board fixing member 3 is formed of a conductive material such as a metal. A first coupling portion 3*a* having male threads on its surface is formed on the upper portion of the board fixing member 3, and is threadably engaged with the transparent body fixing member 2. A second coupling portion 3*b* having female threads on its inner surface is formed on the lower portion of the board fixing member 3 so as to mount the battery holding member 5. A holding portion 3*c* for holding the circuit board 4 is formed between the coupling portions 3*a* and 3*b*.

The above-mentioned light emitter A, the signal processor B, the first pulse generator C, the second pulse generator D, and the photo detector E are assembled on the circuit board 4 with integrated circuits in use of plana mounting print wiring technique in miniature size. The light emitter A and the photo detector E are arranged on the upper surface of the circuit board. For this reason, light can be emitted toward the transparent body 1, and external light can be detected. Electronic parts constituting the signal processor B, the first pulse generator C, and the second pulse generator D are arranged on the lower surface of the circuit board. Furthermore, a contact member 4*b* for a battery 6 is formed on the lower surface of the circuit board 4.

The battery holding member 5 also serves as a battery lid, and is formed of a substantially disk-like conductive material. For this reason, a coupling portion 5*a* having male threads is formed on the peripheral surface of the battery holding member 5, and is threadably engaged with the board fixing member 3. A projection 5*b* is formed on the upper surface of the battery holding member 5 to constitute a contact for the battery 6. The battery 6 is clamped between the contact member 4*b* formed on the lower surface of the circuit board 4 and the projection 5*b* to supply power to the electronic parts assembled on the circuit board 4. Since a groove 5*c* is formed on the lower surface of the battery holding member 5, the battery holding member 5 can be easily attached/detached.

Figure 5:
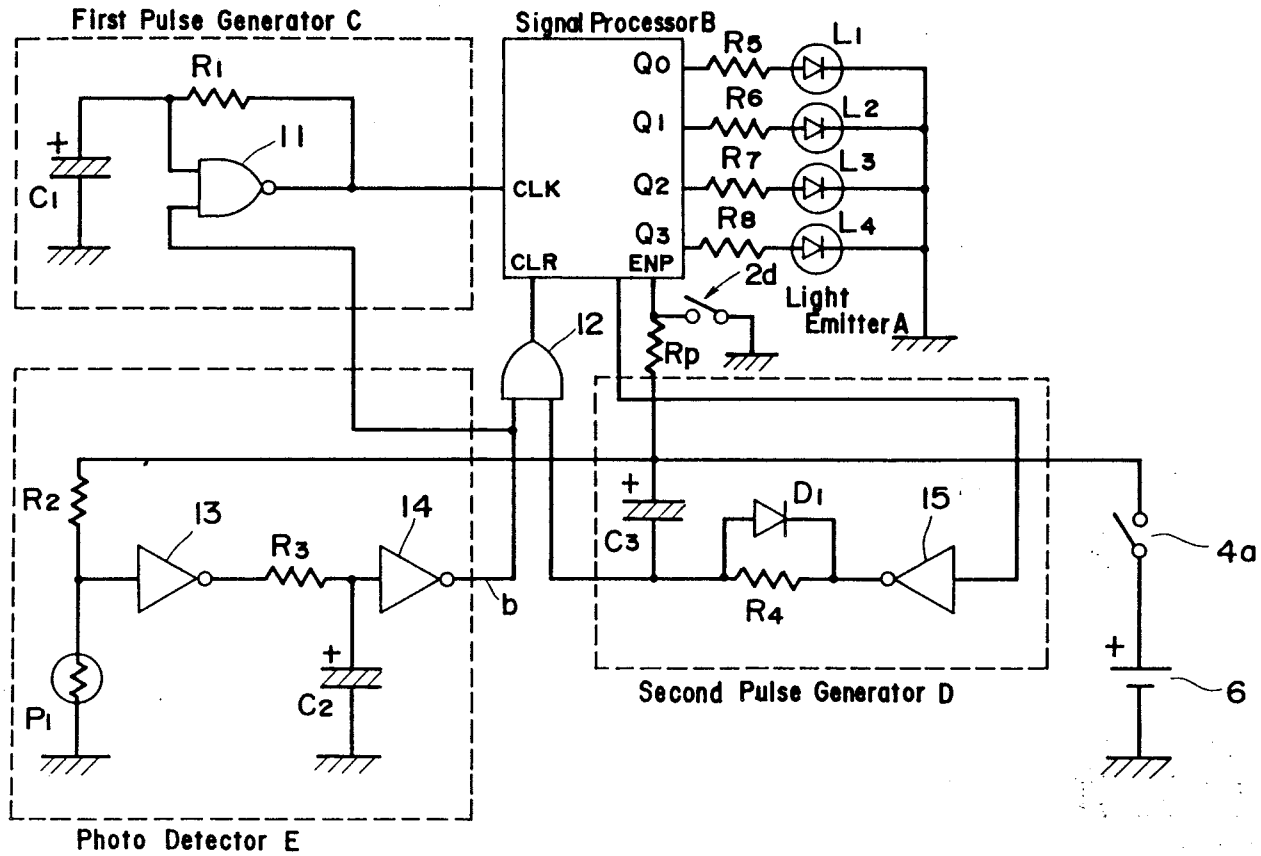
FIG. 5 is a circuit diagram showing an electrical circuit which can be applied to the accessory according to the first embodiment of the present invention.

The circuit arrangement of the light emitter A, the signal processor B, the first pulse generator C, the second pulse generator D, and the photo detector E will be described below with reference to FIG. 5. In this embodiment, four light-emitting elements are used for the light emitter A; a 4-bit binary counter (for example, SN74HC161 of Texas Instruments Co.) for the signal processor B; a clock oscillator for the first pulse generator C; a monostable multivibrator for the second pulse generator D; and a photosensor for the photo detector E.

The first pulse generator C comprises, e.g., a NAND Schmitt gate 11, a resistor R1, and a capacitor C1. The output terminal of the NAND Schmitt gate 11 is connected to the signal processor B. This output terminal is also connected to the resistor R1. The resistor R1 is connected to the "plus(+)" terminal of the capacitor C1. The "minus(−)" terminal of the capacitor C1 is connected to ground. One input terminal of the NAND Schmitt gate 11 is connected between the resistor R1 and the capacitor C1, and the other input terminal is connected to one input terminal of an OR gate 12 connected to the clear (CLR) terminal of the signal processor B.

The photo detector E comprises, e.g., Schmitt inverter gates 13 and 14, a photosensor P1, resistors R2 and R3, and a capacitor C2. The output terminal of the Schmitt inverter gate 14 is connected to the input terminal of the OR gate 12. An integral circuit constituted by the resistor R3 and the capacitor C2 is connected between the Schmitt inverter gate 13 and 14 and the input terminal of the Schmitt inverter gate 13 is connected between the resistor R2 and the photosensor P1. The line from the resistor R2 and the photosensor P1 serves as a power supply line connected to the switch 4*a* and the battery 6.

The second pulse generator D comprises, e.g., a NAND Schmitt gate 15, a diode D1, a resistor R4, and a capacitor C3. The output terminal of the NAND Schmitt gate 15 is connected to the other input terminal of the OR gate 12. The input terminal of the NAND Schmitt gate 15 is connected to the signal processor B. The resistor R4 is connected between the output terminal of the NAND Schmitt gate 15 and the other input terminal of the OR gate 12. The diode D1 is connected in parallel with the resistor R4. The capacitor C3 is connected to a line for connecting the power supply line and a line connecting the resistor R4 and the input terminal of the OR gate 12.

The signal processor B receives the pulse signal from the first pulse generator C, the light detection signal from the photo detector E, and an operation stop signal from the second pulse generator D, and outputs electrical signals to its output terminals Q0, Q1, Q2, and Q3 at predetermined timings. These output terminals are connected to light-emitting elements L1, L2, L3, and L4 through resistor R5, R6, R7, and R8, respectively. For this reason, these electrical signals are sent to the light-emitting elements L1, L2, L3, and L4 at predetermined timings. Further, switch 2*d* is connected between the signal processor B and the power supply line through resistor Rp. The switch 2*d* is connected to ENP terminal in case that a 4-bit binary counter is used for the signal processor. For this reason, closing the switch 2*d* makes the input signal of ENP terminal from low level to high level and its output state of the output terminals Q0, Q1, Q2, and Q3 are held.

Figures 7A, 7B, 7C, 7D, 7E, 7F, 7G:
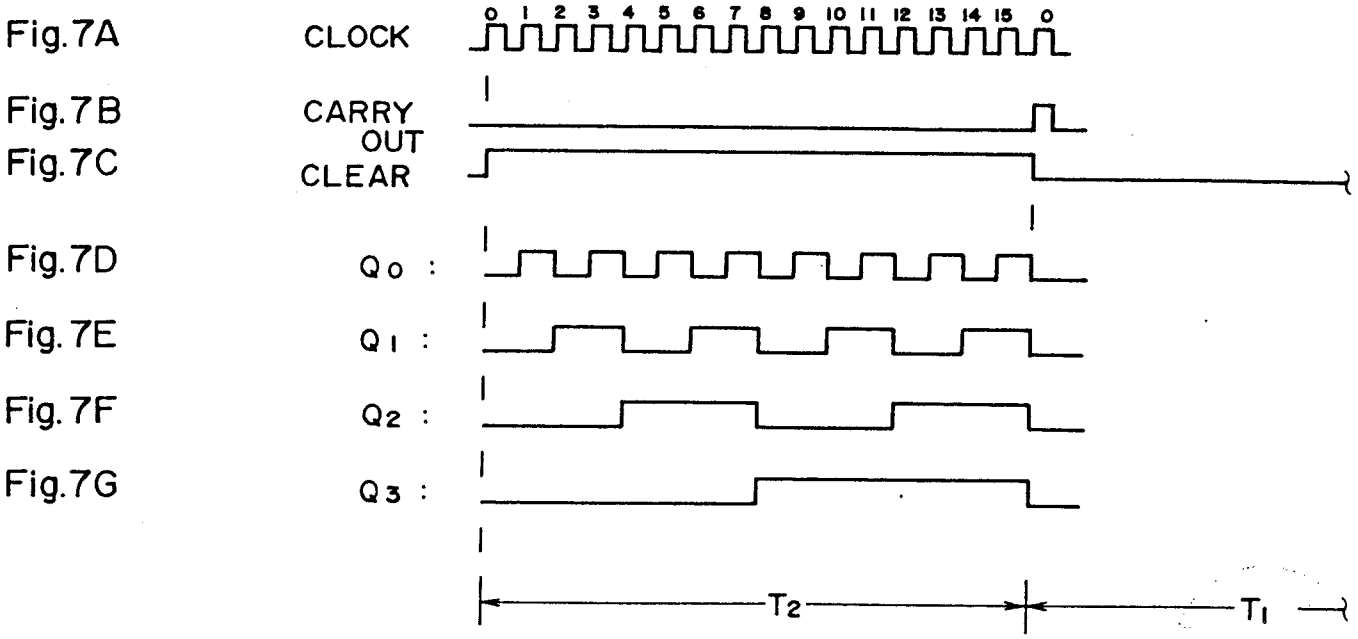
FIGS. 7A, 7B, 7C, 7D, 7E, 7F, and 7G are timing charts of input and output signals of a signal processor according to the first embodiment of the present invention.

The operations of this circuit in dark and bright cases will be described below in turn. First, a dark case (i.e., a case wherein no light is incident) will be described below. When the switch 4*a* is closed, the internal resistance of the photosensor P1 is increased, and after the lapse of a time determined by a time constant of the resistor R2 and the capacitor C2, the output of the Schmitt inverter gate 13 goes to low level. Therefore, the output of the Schmitt inverter gate 14 goes to high level. A high-level interval of the output of the Schmitt inverter gate 14 can be arbitrarily determined by the time constant of the resistor R3 and the capacitor C2. When the output from the Schmitt inverter gate 14 goes to high level, the output from the NAND Schmitt gate 11 goes to high level. Thus, the first pulse generator C starts self-excited oscillation (free running). For this reason, a pulse signal having a short pulse interval shown in FIG. 7A is supplied to the signal processor B.

Figure 6:
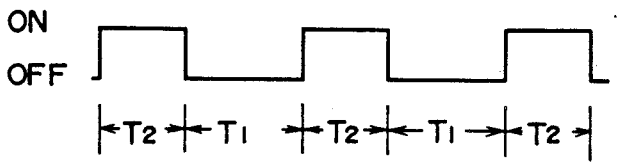
FIG. 6 is a timing chart of a second pulse signal of the second pulse generator according to the first embodiment of the present invention.

In a steady state, since the signal processor B supplies a low-level signal to the NAND Schmitt gate 15, the output from the NAND Schmitt gate 15 is set at high level. For this reason, a high-level signal is input to the input terminal of the OR gate 12. As a result, since the high-level signals are input to the input terminals of the OR gate 12, a high-level signal is output. Thus, the signal processor B is enabled, and electrical signals shown in FIGS. 7D, 7E, 7F, and 7G are supplied to the light emitter A. After the lapse of a predetermined period of time (until 16 pulses are input to the signal processor B), a carry signal (CR) is supplied from the signal processor to the NAND Schmitt gate 15 (FIG. 7B), thus inverting the signal output from the second pulse generator D. In this case, since the signal is converted from high level to low level, a signal input to the CLR terminal of the signal processor B goes to low level (FIG. 7C). In this manner, when the carry signal is input, the output signal from the second pulse generator D can be changed, as shown in FIG. 6. If pulse intervals shown in FIG. 6 are represented by T1 and T2, the signal processor B is enabled for the time interval T2, and is disabled for the time interval T1. After the lapse of time determined by the time constant of the resistor R4 and the capacitor C3, the signal output from the second pulse generator D goes to high level again, and the signal processor B is enabled again.

Even if it becomes dark and the internal resistance of the photosensor P1 is increased, the output from the Schmitt inverter gate 13 does not go to low level unless the time determined by the time constant of the resistor R2 and the capacitor C2 has elapsed. Therefore, the operation of the signal processor B will not be interrupted by an ON state of the light emitter A.

FIG. 8 shows timings at which the signal processor B supplies the electrical signals to the light emitter A in enabled state. In this case, the light-emitting element L1 emits light in response to a first clock, the light-emitting element L2 emits light in response to a second clock, and the light-emitting elements L1 and L2 emit light in response to a third clock. In this manner, when the 4-bit binary counter is used, a large number of combinations or patterns of light emission can be realized. Further, present emitting state can be held when the switch 2*d* is closed in enable state.

In a bright case, since the light detection signal is supplied to the signal processor B, the internal resistance of the photosensor P1 is decreased, and the output from the Schmitt inverter gate 13 goes to high level. Therefore, the output from the Schmitt inverter gate 14 goes to low level. A low-level interval of the output from the Schmitt inverter gate 14 can be arbitrarily determined by the time constant of the resistor R3 and the capacitor C2. When the output from the Schmitt inverter gate 14 goes to low level, the output from the NAND Schmitt gate 11 goes to low level. Therefore, oscillation of the first pulse generator C is stopped. In this case, since one input signal of the OR gate 12 goes to low level, the output signal from the OR gate 12 goes to low level regardless of the input signal from the second pulse generator D. Thus, the signal processor B is kept cleared. In this case, since no pulse is input from the first pulse generator C, no carry signal is supplied from the signal processor B to the second pulse generator D.

Figure 9:
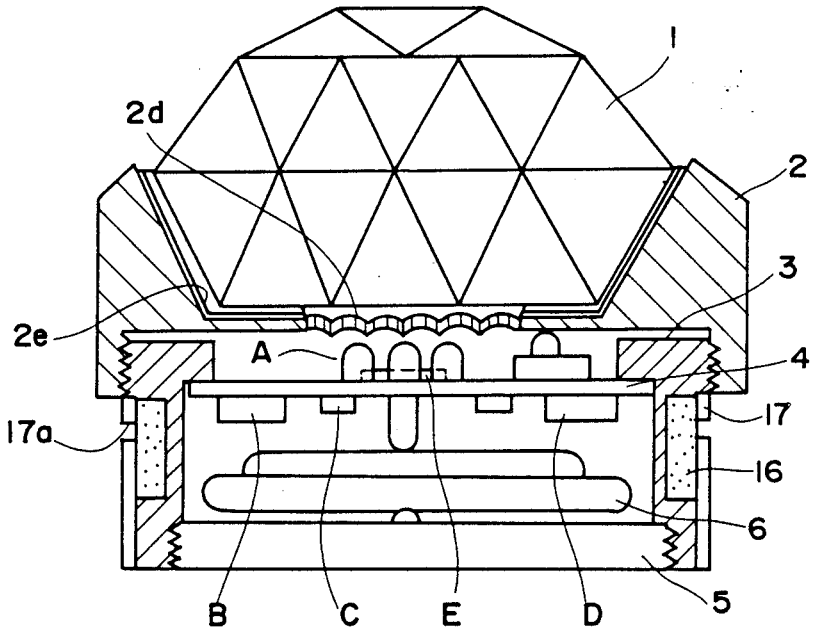
FIG. 9 is a longitudinal section view showing a structure of an accessory according to the second embodiment of the present invention.

FIG. 9 shows a structure of an accessory according to the second embodiment of the present invention. Differences from the first embodiment are that a light scattering portion 2*d* is formed on the fringe 2*c* formed at the central portion of the transparent body fixing member 2, a reflecting film 2*e* is coated on a region of the holding portion 2*a* facing the transparent body, and a cotton member 16 soaked with an aromatic is filled in the side surface of the board fixing member 3. In this embodiment, a large number of small holes 17*a* are formed in the outer surface of a cylindrical member 17 fitted outside the board fixing member 3, and the aromatic is evaporated from these holes 17*a*. Therefore, according to this embodiment, light emitted from the light emitter is satisfactorily scattered and the scattered light components are incident on the transparent body 1. As a result, a person can experience further brilliance. The effect of the aromatic can comfortably stimulate the sense of smell of persons near the person wearing the accessory. In this embodiment, fluorescent may be coated on a region of the holding portion 2*a* facing the transparent body 1 instead of reflecting film and the aromatic may be state of jelly or solid.

Note that the present invention is not limited to the above embodiments. For example, the light emitter A, the signal processor B, the first pulse generating means C, the second pulse generator D, and the photo detector D need not be assembled on a single circuit board.

Figure 10C:
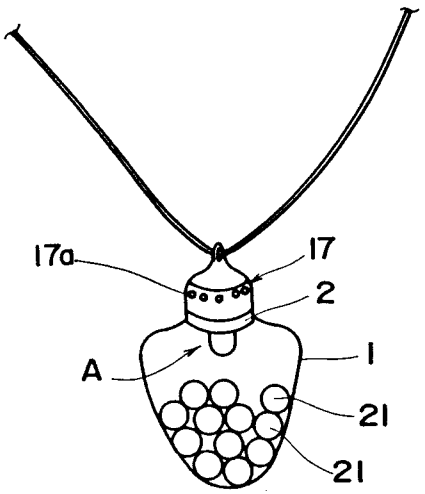
FIGS. 10A, and 10B are perspective views showing applications of the accessory according to the first embodiment of the present invention.
Figure 10B:
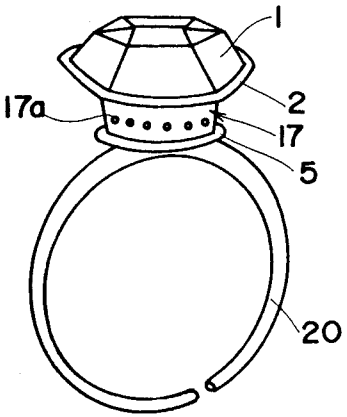
Figure 10A:
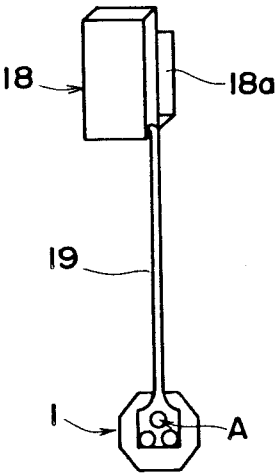

FIGS. 10A to 10C show applications of the accessory of the first embodiment of the present invention. In FIG. 10A, the present invention is applied to an earring. A difference from the above embodiment is that the transparent body 1 and the light emitter A are arranged to be separated from the circuit board. The signal processor B, the first pulse generator C, the second pulse generator D, and the photo detector E are assembled on a circuit board (not shown) housed in a case 18. An ear clip 18*a* is formed on the case 18. The case 18 is connected to the light emitter A through a lead wire 19.

In FIG. 10B, the present invention is applied to a ring. In this case, the surface of the transparent body is subjected to so-called brilliant cut, so that internal light is satisfactorily radiated to the outside. A large number of small holes 17*a* are formed in a line in the outer surface of the cylindrical member 17, so that the aromatic is evaporated therethrough. Note that a ring member 20 is fixed to the battery holding member 5.

In FIG. 10C, the present invention is applied to a pendant. A difference from the above embodiment is that a single-color light emitter A is used, and colored glass beads 21 are filled in the transparent body 1. The colored glass beads 21 are movable in the case 1. According to this embodiment, light of various colors can be experienced according to the states of the colored glass beads 21.

Further, this invention can be applied to a sash clip, a tiepin, a necklace, a bracelet, etc.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An accessory utilizing a light emitter, comprising:

said light emitter, arranged near a transparent body, for intermittently emitting light upon reception of an electrical signal;

first pulse generator for generating a first pulse signal at a relatively short pulse interval;

photo detector for detecting light incident on said transparent body and generating a light detection signal;

second pulse generator for generating a second pulse signal at a relatively long pulse interval; and signal processor for receiving the first pulse signal, the second pulse signal, and the light detection signal and supplying the electrical signal to said light emitter at a predetermined timing.

2. An accessory according to claim 1, wherein said light emitter emits light to said transparent body through a light scattering member.

3. An accessory according to claim 1, wherein said light emitter, said first pulse generator, said photo detector, said second pulse generator, and said signal processor are fixed on a single circuit board.

4. An accessory according to claim 1, wherein said light emitter and said photo detector are fixed on an upper surface of a circuit board facing said transparent body, and said first pulse generator, said second pulse generator, and said signal processor are fixed on a lower surface of the circuit board.

5. An accessory according to claim 1, further including a board fixing member for fixing a circuit board, and a transparent body fixing member, attached to said board fixing member, for fixing said transparent body.

6. An accessory according to claim 5, wherein said board fixing member comprises a storage portion for storing an aromatic, said storage portion communicating with external air through small holes.

7. An accessory according to claim 5, wherein said transparent body fixing member has a reflecting film coated on a surface for holding said transparent body.

8. An accessory according to claim 5, wherein said circuit board comprises a power switch which is closed when said transparent body fixing member is mounted on said board fixing member.

9. An accessory according to claim 5, wherein said transparent body fixing member has a fluorescent film coated on a surface for holding said transparent body.

10. An accessory according to claim 1, wherein said light emitter comprises a light-emitting element, said first pulse generator comprises a clock oscillator, said photo detector comprises a photosensor, said second pulse generator comprises a monostable multivibrator, and said signal processor comprises a 4-bit binary counter.

11. An accessory according to claim 1, wherein said light-emitting element, said clock oscillator, said photosensor, said monostable multivibrator, and said 4-bit binary counter are mounted on a single printed circuit board.

12. An accessory according to claim 1, wherein said second pulse generator generates a pulse signal having a pulse interval longer than at least that of the first pulse signal.

13. An accessory according to claim 1, wherein said signal processor supplies a carry signal to said second pulse generator.

14. An accessory according to claim 1, wherein said light emitter is fixed to a member separated from a circuit board on which said first pulse generator, said photo detector, said second pulse generator, and said signal processor are fixed.

15. An accessory according to claim 1, wherein a plurality of colored transparent beads are arranged between said transparent body and said light emitter.

16. An accessory according to claim 1, wherein said light emitter is used as an accessory body of an earring.

17. An accessory according to claim 1, wherein said light emitter is used as an accessory body of a ring.

18. An accessory according to claim 1, wherein said light emitter is used as an accessory body of a pendant.

19. An accessory according to claim 1, wherein said light emitter is used as an accessory body attached to a human body.

20. An accessory according to claim 1, wherein said signal processor further comprises output signals holding means for holding the output state of said electrical signals.

* * * * *